United States Patent [19]

White et al.

[11] Patent Number: 5,035,133

[45] Date of Patent: Jul. 30, 1991

[54] METHOD AND APPARATUS FOR HOT DIE DRAW FORMING METAL SHEETS

[75] Inventors: Robert T. White, Spring Valley; Thomas J. Liebig, Chula Vista; Jeffrey K. Switzer, Poway, all of Calif.

[73] Assignee: Rohr Industries, Inc., Chula Vista, Calif.

[21] Appl. No.: 477,452

[22] Filed: Feb. 9, 1990

[51] Int. Cl.[5] ..... B21D 24/08

[52] U.S. Cl. ..... 72/350; 72/296

[58] Field of Search ..... 72/296, 297, 309, 350, 72/351, 400, 401, 381, 57

[56] References Cited

U.S. PATENT DOCUMENTS

| | | | |
|---|---|---|---|
| 2,342,437 | 2/1944 | Summers | 72/457 |
| 2,354,003 | 7/1944 | Ernst et al. | 72/417 |
| 3,314,275 | 4/1967 | Mullen | 72/350 |
| 3,564,895 | 2/1971 | Pfanner et al. | 72/351 |

*Primary Examiner*—Lowell A. Larson
*Assistant Examiner*—M. J. McKeon
*Attorney, Agent, or Firm*—Patrick J. Schlesinger; Frank D. Gilliam

[57] ABSTRACT

A method and apparatus for draw forming a metal sheet over a male form to produce a three-dimensional shape. A sheet of metal is clamped between upper and lower draw plates positioned above the male form. The upper plate has an edge conforming to the male form shape. The plates and sheet are moved downwardly over the form with the edge of the upper plate firmly pressing the sheet against the form. The clamping pressure between the draw plates allows suitable slippage as drawing proceeds to produce a drawn shape of intended thickness. The drawn shape has a configuration conforming to the outer surface of the male form and has an outer surface of improved uniformity and appearance due to the wiping action of the upper plate edge.

8 Claims, 2 Drawing Sheets

METHOD AND APPARATUS FOR HOT DIE DRAW FORMING METAL SHEETSc1

BACKGROUND OF THE INVENTION

This invention relates in general to the draw forming of metal sheets and, more specifically, to a method and apparatus for deep draw forming complex shapes.

A wide variety of methods and apparatus have been developed of forming metal sheets into three-dimensional products. These methods and apparatus are of varying effectiveness, depending on the shape to be produced and physical characteristics required in the product.

Stretch forming, in which opposite edges of a large metal sheet are clamped with a plurality of clamps and the sheet is stretched over a three-dimensional form, is widely used for large panels such as aircraft fuselage skins. Typical of these methods is that disclosed by Gray in U.S. Pat. No. 3,299,688. While very useful with large panels with minor reshaping, this method is difficult to apply to more significant reshaping of smaller panels.

Aluminum beverage cans and similar shapes are often formed from sheet material by a punch moving through an opening in a circular clamping mechanism which holds the sheet, such as is described by Clowes in U.S. Pat. No. 3,789,649. While effective for small parts, it has proven difficult to apply the punch techniques to large parts, where wrinkles, orange peel and grain growth may occur, reducing panel strength and producing a poor cosmetic appearance.

Other methods have been used for forming large shapes from sheet material, such as drop hammer forming, cold drawing, hydro bulge forming, etc. These methods tend to require several forming steps, with intermediate heat treating, to prevent excessive grain growth and often require considerable hand work on the product for cosmetic reasons. Spin forming is useful in some cases, but is limited to round or near-round shapes. Super plastic forming has advantages, but tends to be complex and expensive, be limited in suitable alloys and the product requires considerable surface cleanup.

Thus, there is a continuing need for an improved method and apparatus for forming three-dimensional shapes from sheet metal which is simple, economical and produces a product having a surface requiring little, if any, hand finishing.

SUMMARY OF THE INVENTION

The above-noted problems, and others, are overcome in accordance with this invention, fundamentally, by a method and apparatus in which a sheet of metal is clamped between upper and lower draw plates adjacent to a male form, the clamped sheet is drawn down over the male form with a rounded edge of the upper plate firmly pressing the sheet against the male form. Upon completion of draw plate movement, a three-dimensional product having a configuration conforming to that of the male form results. The product has a very high quality exterior surface, apparently due to the wiping/coining action of the upper plate edge.

The male form includes internal heating devices to maintain the form at a desired elevated temperature. The entire apparatus is located within an enclosure and maintained at a suitable elevated temperature. Typically, these temperatures may be about 300° F. for aluminum 2219 alloy.

BRIEF DESCRIPTION OF THE DRAWING

Details of the invention, and of a preferred embodiment thereof, will be further understood upon reference to the drawing, wherein.

DETAILED DESCRIPTION OF PREFERRED EMBODIMENTS

Figure 1:
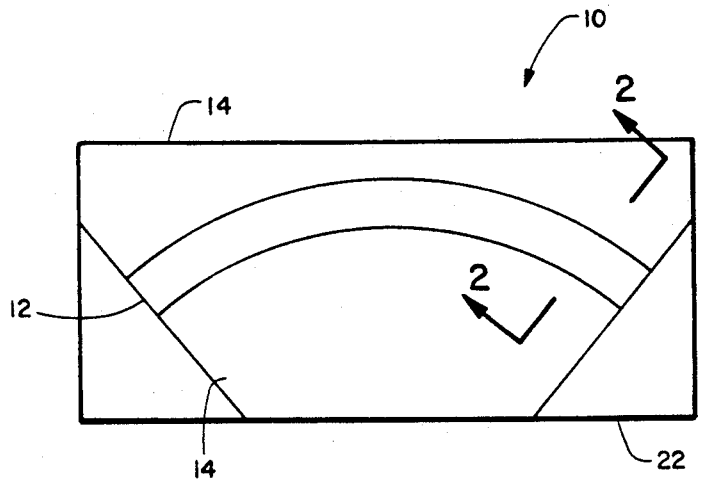
FIG. 1 is a schematic plan view of the apparatus of this invention.
Figure 2:
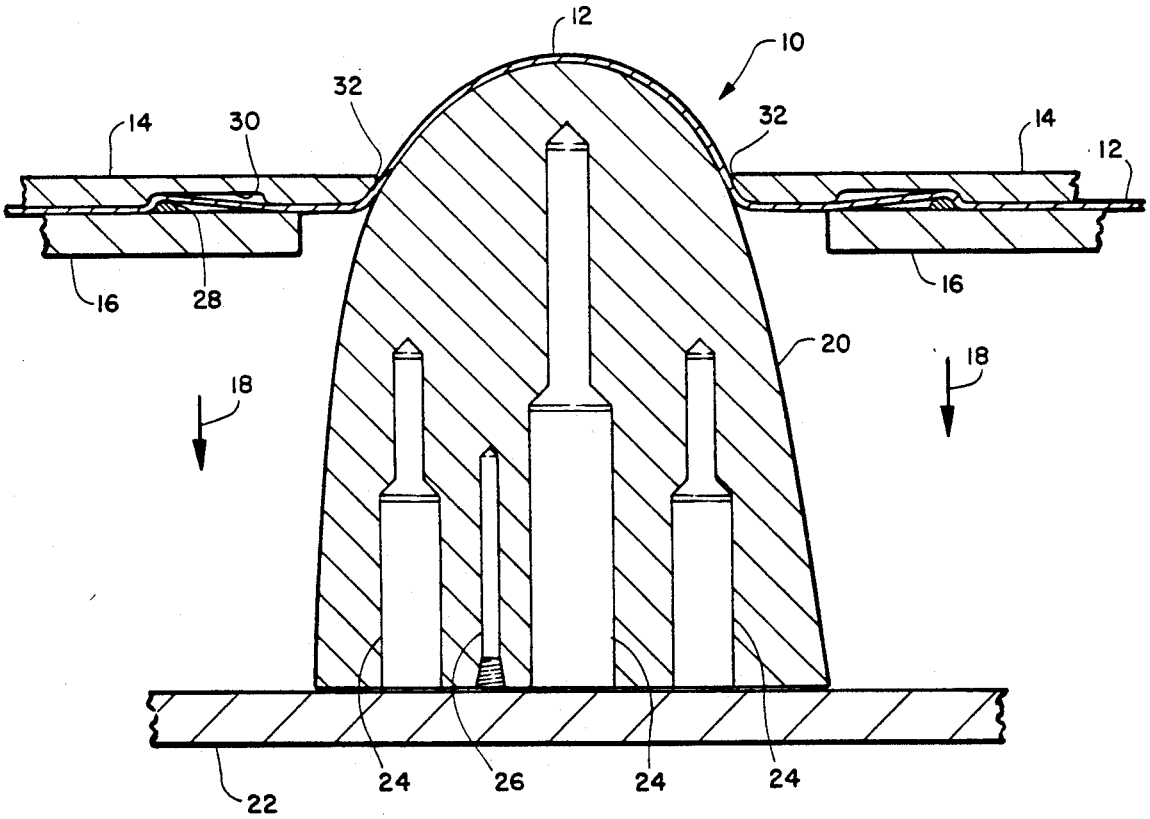
FIG. 2 is a schematic section view taken on line 2—2 in FIG. 1 at the beginning of the drawing operation.

Considering FIGS. 1 and 2 together, there is seen hot drawing assembly 10 at the beginning of the drawing operation. In this embodiment, a segment of a generally circular inlet lip for a jet engine nacelle is to be formed.

A sheet of metal 12 to be reshaped is clamped between upper draw plate 14 and lower draw plate 16. Plates 14 and 16 are supported by a large conventional hydraulic press (not shown) which moves the plate assemblies downwardly, as indicated by arrows 18.

A male form 20 rest on a base plate 22. Form 20 may be made from any suitable material, such as Kirksite. A plurality of electrical heaters 24 are embedded within form 20. Thermocouples 26 are also embedded in form 20 to continuously measure internal temperature.

The entire assembly 10 is contained within an enclosure. The temperature of the enclosure and form 20 is regulated by a conventional heater controller, not shown. For aluminum alloys, male form 20 and the sheet to be formed should be maintained at a temperature of from about 300° to 500° F.

A bead 28 secured to the upper surface of lower plate 16 forces metal sheet 12 slightly upwardly into a wide groove 30 in the lower surface of upper clamp plate 14.

Bead 28 clamps metal sheet against the inner wall of groove 30 to produce uniform clamping pressure around the forming region and to permit slippage at the desired rate during forming.

Prior to the forming operation, metal sheet 12 is held flat between draw plates 14 and 16 above form 20 as the plate assembly is lowered, metal sheet 12 engages and begins to conform to form 20. Upper draw plates 14 are pressed toward form 20, firmly pressing sheet 12 thereagainst. The engaging edge 32 is curved to provide a wiping or coining action which smoothes the surface of metal sheet 12 reducing or eliminating surface defects.

Edge 32 is pressed against sheet 12 with any suitable pressure, as schematically indicated by springs 34. Typically, this pressure may be in the 0 to 500 psi range with aluminum alloys such as 2219. Conventional empirical tests will be used to select optimum edge pressures for other alloys.

Figure 3:
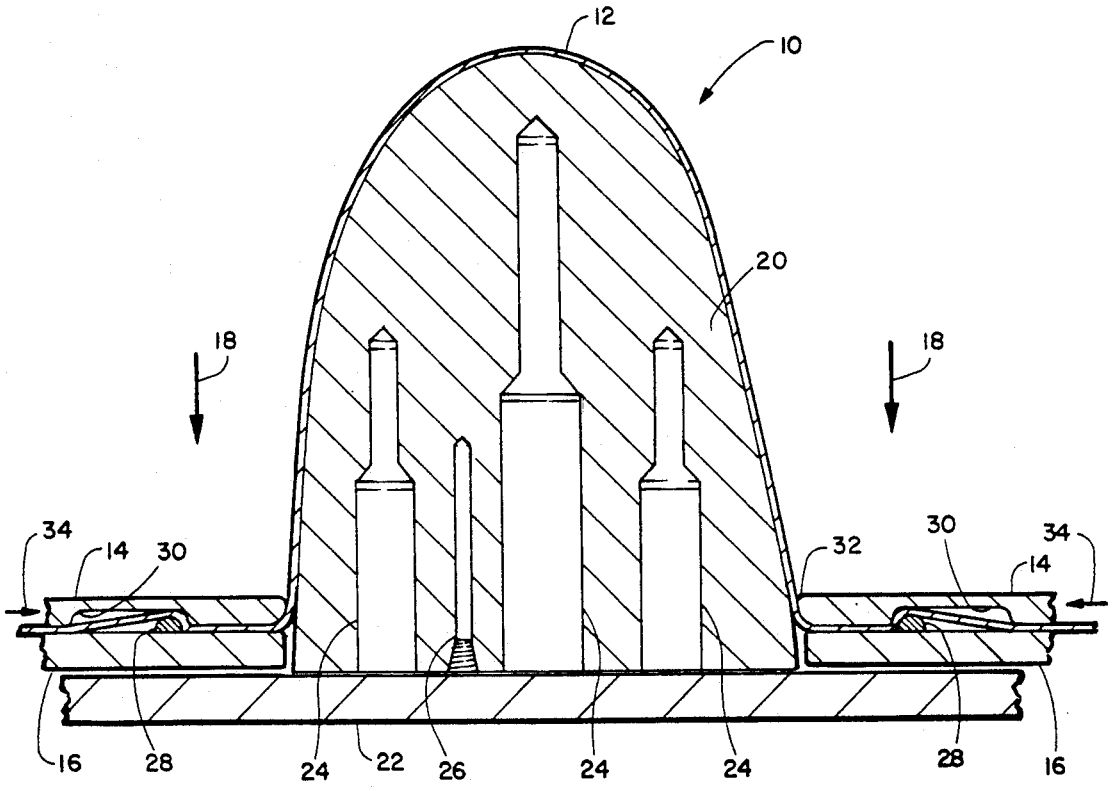
FIG. 3 is a schematic section view taken on line 2—2 in FIG. 1 at completion of the drawing operation.

As the plate assembly moves downwardly to the final position shown in FIG. 3, metal sheet 12 slides out from between clamp plates 14 an 16 onto the surface of form 20. As form 20 widens, upper plate 14 moves outwardly relative to lower plate 16, with groove 30 moving outwardly but still accommodating bead 28. The pressure between draw plates 14 and 16 need only be sufficient to permit smooth feeding of metal sheet 12 past edge 32, typically in the 40 to 120 psi range.

While certain specific configurations and arrangements were described in the above description of a preferred embodiment, those can be varied, where suitable, with similar results. Other applications and variations of this invention will occur to those skilled in the art. Those are intended to be included within the scope of this invention as defined in the appended claims.

We claim:

1. The method of drawing forming sheet metal into a product having a complex shape which comprises the steps of:

providing a male form conforming to the interior shape of the product;

providing upper and lower draw plates having relative movement therebetween, said upper plates each having an edge conforming to a corresponding surface of said male form and an elongated upstanding bead on the upper surface of said lower plate and a corresponding groove on the lower surface of said upper plate, said groove in said lower surface having sufficient width to accommodate relative movement between the bead and groove surfaces during drawing;

clamping a sheet of metal between said upper and lower plates, said bead and groove adapted to press said sheet therebetween during drawing;

heating said sheet and said male form to a selected elevated temperature; and drawing said sheet of metal downwardly, transverse to said relative movement of said upper and lower draw plates, over said male form with said upper plate edge pressing said metal sheet firmly against said male mold;

the clamping pressure between said upper and lower plates selected to allow said sheet to slip from between said plates as drawing progresses.

2. The method according to claim 1 wherein said edge is pressed against said sheet during drawing with a pressure in the range of 0 to 500 psi.

3. The method according to claim 2 wherein said edge is rounded to provide a wiping and coining action on the exterior surface of said metal sheet during drawing.

4. The method according to claim 1 wherein said metal comprises aluminum and said sheet and said form are heated to a temperature in the range of 300° to 500° F.

5. The method according to claim 1 wherein said upper and lower plates are clamped together at a pressure in the range of 40 to 120 psi during draw.

6. Apparatus for draw forming sheet metal over a male form to produce a product having a complex shape which comprises:

a male form having an exterior shape corresponding to the interior shape of the product;

upper and lower draw plates positioned adjacent to said male form and adapted to clamp a sheet of metal therebetween, an elongated upstanding bead on the upper surface of said lower plate and a corresponding groove on the lower surface of said upper plate, said groove in said lower surface having sufficient width to accommodate relative movement between the surfaces during drawing, said bead and groove adapted to press said sheet therebetween during drawing;

heating means for heating said form and a metal sheet clamped between said plates to a selected temperature;

said upper plate having edges corresponding to the shape of said metal form;

means for moving the assembly of sheet and plates downwardly, transverse to the relative movement of said upper and lower draw plates, over said form with said sheet in contact with said form; and means for firmly pressing said edges of said upper plate toward said form.

7. The apparatus according to claim 6 wherein said edge is rounded to cause a wiping and coining action on a metal sheet as said edge is moved along a metal sheet on said form.

8. The apparatus according to claim 6 wherein said means for pressing said edge toward said form is adapted to produce pressure in the range of 0 to 500 psi.

* * * * *